United States Patent [19]

Lee et al.

[11] Patent Number: 4,751,111

[45] Date of Patent: Jun. 14, 1988

[54] METHOD FOR PRODUCING LOW SHEET GLOSS COATED PAPER

[75] Inventors: Do I. Lee; Ronald E. Hendershot, both of Midland, Mich.

[73] Assignee: The Dow Chemical Company, Midland, Mich.

[21] Appl. No.: 858,997

[22] Filed: May 2, 1986

[51] Int. Cl.[4] ..... B05D 3/12; B32B 23/08; B32B 27/10

[52] U.S. Cl. ..... 427/361; 427/365; 427/391; 428/511; 428/514

[58] Field of Search ..... 427/361, 365, 366, 391; 428/511, 514

[56] References Cited

U.S. PATENT DOCUMENTS

| | | | |
|---|---|---|---|
| 4,258,104 | 3/1981 | Lee et al. | 427/391 X |
| 4,397,984 | 8/1983 | Wendel et al. | 427/391 X |
| 4,423,118 | 12/1983 | Corbett et al. | 427/391 X |
| 4,613,633 | 9/1986 | Sekiya et al. | 427/391 X |

*Primary Examiner*—Michael R. Lusignan

[57] ABSTRACT

The improvement in the production of low sheet gloss coated papers which comprises using as the synthetic polymer latex binder for the aqueous coating composition employed to coat the papers, a carboxylated latex which substantially swells during the preparation of the aqueous coating composition and subsequently shrinks during the drying of the coated paper, whereby a microscopic surface roughness is obtained to yield a low sheet gloss coated paper while retaining high ink gloss.

10 Claims, No Drawings

METHOD FOR PRODUCING LOW SHEET GLOSS COATED PAPER

BACKGROUND OF THE INVENTION

The coating of papers with a variety of pigmented colors is well known in the paper-making industry. For some coated paper applications, low sheet gloss is a desirable attribute. Low gloss coated papers, i.e., those having a matte or dull finish, are produced by using large particle size pigments or by special finishing techniques such as etched or sandblasted supercalender rolls. Although these techniques produce low sheet gloss in the resultant coated paper, they can also adversely affect other coated paper characteristics, such as printability. When large particle size pigments or surface roughening calendering techniques are used high ink gloss and printability may suffer.

Therefore, it would be desirable to provide a method of achieving low sheet gloss coated paper without the necessity of using large pigment particles and/or specialized calendering techniques such that low sheet gloss is obtained but high ink gloss is also retained.

SUMMARY OF THE INVENTION

The present invention generally relates to a method of coating paper wherein an aqueous coating composition containing an inorganic pigment and a synthetic polymer latex as a binder is prepared, applied to a paper surface and the paper is subsequently dried to produce a coated paper. Applicants have found that by utilizing certain carboxylated latexes as a synthetic polymer latex in such a process, the dried coated paper will have a low sheet gloss and high ink gloss. The carboxylated latexes that are to be used are those which have carboxylation such that the latex swells substantially during the preparation of the coating composition and shrinks during the drying of the coated paper to produce microscopic roughness on the dried coated paper surface.

Utilizing the carboxylated latex, as defined herein, as the binder material of choice in the paper coating process enables low sheet gloss coated papers to be prepared without the use of large pigment particles and/or specialized supercalendering techniques. The improvement of using these carboxylated latexes is the production of a low sheet gloss coated paper without detrimental effect on ink gloss, or the printing characteristics of the coated paper.

DETAILED DESCRIPTION OF THE INVENTION

The preparation of aqueous paper coating compositions containing inorganic pigment(s) and synthetic polymer latex binder(s) are well known in the art. Such composition may also include natural cobinders such as starch, proteins and blends thereof. Also the techniques for applying such coating compositions to the paper surface and the subsequent drying of the paper are well known in the paper making art.

In the method of the present invention, certain carboxylated latexes are employed as the latex of choice in the binder system for the aqueous paper coating composition. The carboxylated latexes to be used are those in which the particles of the latex swell substantially during the preparation of the aqueous coating composition and subsequently reduce in volume or shrink during the drying of the coated paper. Preferably, the carboxylated latexes employed in the present invention have particles which swell to at least about twice their volume in the aqueous coating composition relative to their volume at low pH, i.e., below about pH 5, as a latex prior to being incorporated into the aqueous coating composition.

Carboxylated latexes and their methods of preparation are generally taught in the art. The carboxylation is introduced by utilizing as one of the comonomers in the preparation of the latex a vinyl acid, such as acrylic acid, methacrylic acid, itaconic acid, fumeric acid, and maleic acid. Preferred carboxylated latex systems to be utilized in the present invention include styrene/butadiene based latexes containing at least about 6 parts of a vinyl acid monomer per 100 parts of total monomers and more preferably from about 6 parts to about 25 parts of a vinyl acid monomer per 100 parts of total monomers. Also included are acrylate based polymer latexes such as ethyl acrylate, methyl methacrylate or styrene/ethyl acrylate wherein the vinyl acid monomer is at least about 6 parts, more preferably from about 6 to about 40 parts, based on the total weight of monomers. Still other latexes include vinyl acetate based polymers which incorporate at least about 5 parts vinyl acid monomer, preferably from about 5 to about 20 parts vinyl acid monomer, based on the total weight of the monomers. Carboxylated latexes with too low a vinyl acid monomer addition will not achieve the requisite swelling in the production of the aqueous coating composition nor the requisite shrinkage in the subsequent drying of the coated paper to produce the microscopic roughness on the dried coated paper surface necessary to obtain low sheet gloss.

In preparing the aqueous coating composition containing one or more inorganic pigments and the specified carboxylated latex, it is desirable to prepare such aqueous coating composition under high pH conditions, preferably at least a pH of 8 or above. The pH of the aqueous coating composition can be increased or altered in a number of ways, such as by the addition of a base. For a given carboxylated latex, the increased pH condition during the preparation of the aqueous coating composition results in a coated paper with a lower sheet gloss as compared to a coated paper prepared from the same aqueous coating composition made at a lower pH.

While maximum benefit of the present invention is obtained by using the specified carboxylated latex or a blend of such latex(es) as the sole binder for the aqueous coating composition, improvements in the coated paper process can also be achieved by using the specified latex as a blend with other latexes, e.g., comparatively low carboxylated latexes or non-carboxylated latexes, as the binder system in the aqueous coating composition. Similarly, cobinders, e.g., natural binders such as starch or proteins or synthetic binders such as polyvinyl alcohol, hydroxyalkyl cellulose, and polyacrylamide, may be incorporated with the latex as the total binder system for the coating composition.

Moreover, the specified carboxylated latex can be heterogenous in composition of the latex particle, such as the core/shell type in which the shell comprises the requisite carboxylated latex.

In the subsequent calendering of the paper coated by the method of the present invention a wide variety of calendering techniques may be employed. However, it is desirable to carry out the step of calendering the coated paper under conditions which retain the microscopic roughness of the coated paper surface whereby the calendered paper will retain the low sheet gloss without loss of the high ink gloss character.

The following examples further illustrate the method of the present invention.

The latexes described below were used in the examples to prepare the coated paper samples.

Latex I: A styrene/butadiene/acrylic acid/hydroxyethyl acrylate latex prepared from a monomer mixture (by weight) of 440 parts styrene, 360 parts butadiene, 140 parts acrylic acid and 60 parts hydroxyethyl acrylate, i.e., 14 parts of acrylic acid per 100 parts of total monomers.

Latex II: A styrene/butadiene/acrylic acid latex prepared from a monomer mixture (by weight) of 580 parts styrene, 380 parts butadiene and 40 parts acrylic acid, i.e., 4 parts acrylic acid per 100 parts of total monomers.

Latex III: A styrene/butadiene/acrylic acid latex prepared from a monomer mixture (by weight) of 560 parts styrene, 360 parts butadiene, and 80 parts acrylic acid, i.e., 8 parts of acrylic acid per 100 parts of total monomers.

Latex IV: A styrene/butadiene/acrylic acid latex prepared from a monomer mixture (by weight) of 520 parts styrene, 380 parts butadiene, and 100 parts acrylic acid, i.e., 10 parts of acrylic acid per 100 parts of total monomers.

EXAMPLE 1

An aqueous coating composition was prepared by blending the following ingredients by weight:

1. No. 2 kaolin clay—70 parts,
2. calcium carbonate—30 parts,
3. Latex I binder—17 parts,
4. sodium hydroxide to produce a pH of the aqueous coating composition of 11,
5. water to a total solids of 58 percent.

The carboxylated latex was such that it swelled substantially upon its incorporation into the aqueous coating composition and subsequently shrunk during the drying of the paper coated with the aqueous coating composition described above.

A paper substrate was coated utilizing an inverted puddle blade coater. The paper so coated was dried utilizing a heated drum operated at 155° C. The dried coated paper was conditioned in accordance with TAPPI Standard T-402 for 12 hours. The dried coated paper was supercalendered using a calendering machine at 150° C. and 1,000 pli.

COMPARATIVE EXAMPLE A

The same procedure as Example 1 was used to prepare a calendered coated paper utilizing Latex II as the latex binder. This latex did not swell substantially upon incorporation into the coating composition.

The calendered coated papers of Example 1 and Example A were tested for sheet gloss using the TAPPI 75° test and an ink gloss test (red heat set ink at a constant ink density) to determine the relative sheet gloss and the relative ink gloss. Table I reports the results.

TABLE I

| Example | Sheet Gloss | Ink Gloss |
|---|---|---|
| 1 | 36.3 | 73.1 |
| A | 48.1 | 72.7 |

It can be seen from the comparison of the data in Table I that using the highly swellable carboxylated latex (Latex I) results in a lower sheet gloss coated paper while maintaining the relatively high ink gloss.

EXAMPLES 2–4 AND COMPARATIVE EXAMPLE B

Another series of calendered coated papers was prepared in the same manner as Example 1, except that the solids level of the aqueous coating composition was 60 percent and the pH was adjusted to 9. The latexes employed in each example are listed in Table II.

The calendered coated papers of Examples 2, 3, 4 and B were tested for sheet gloss and ink gloss in the same manner as Example I. Table II shows the results of such tests.

TABLE II

| Example | Latex | Sheet Gloss | Ink Gloss |
|---|---|---|---|
| 2 | III | 44.7 | 72.2 |
| 3 | IV | 42.1 | 72.7 |
| 4 | I | 40.3 | 72.0 |
| B | II | 47.6 | 72.7 |

The latexes with higher carboxylation (Latexes I, III, and IV) swelled substantially during the preparation of the aqueous coating composition and shrunk during the drying of the coated paper. Lower sheet gloss is obtained without sacrificing the high ink gloss (Examples 2–4).

EXAMPLES 5 AND 6 AND COMPARATIVE EXAMPLE C

Two acrylate latexes with heterogenous compositions were prepared by polymerizing a first monomer feed mixture of styrene, butadiene and methacrylic acid, and then polymerizing a second monomer feed mixture of ethyl acrylate, methyl methacrylate and methacrylic acid. For comparison a latex with no second feed was prepared. The latex monomer feed compositions are listed below.

Latex V: First monomer feed—44.1 parts styrene, 24.5 parts butadiene, and 1.4 parts methacrylic acid; second monomer feed—12 parts ethyl acrylate, 12 parts methyl methacrylate and 6 parts methacrylic acid, i.e., 7.4 parts methacrylic acid per 100 parts of total monomers.

Latex VI: First monomer feed—50.4 parts styrene, 28 parts butadiene and 1.6 parts methacrylic acid; second monomer feed—8 parts ethyl acrylate, 8 parts methyl methacrylate, and 4 parts methacrylic acid, i.e., 5.6 parts methacrylic acid per 100 parts of total monomers.

Latex VII: First monomer feed—63 parts styrene, 35 parts butadiene, and 2 parts methacrylic acid; second monomer feed—none, i.e., 2 parts methacrylic acid per 100 parts of total monomers.

An aqueous coating composition was prepared by blending the following ingredients by weight.

1. No. 2 kaolin clay—70 parts,
2. calcium carbonate—30 parts,
3. latex binder—15 parts,
4. sodium hydroxide to produce a pH of the aqueous coating composition of 9,
5. water to a total solids of 60 percent.

Coated paper samples were prepared and tested in the same manner as Example 1 except the ink gloss test was green air set ink at a constant ink density. The results are given in Table III.

TABLE III

| Example | Latex | Sheet Gloss | Ink Gloss |
|---|---|---|---|
| 5 | V | 40 | 62 |
| 6 | VI | 48 | 61 |
| C | VII | 51 | 63 |

The acrylate latexes with higher carboxylation swelled substantially during the preparation of the aqueous coating composition and shrunk during the drying of the coated paper to produce a lower sheet gloss (Examples 5 and 6) than the paper coated with the coating prepared from the lower carboxylation latex.

What is claimed is:

1. In a method of paper coating wherein an aqueous coating composition containing effective amount of an inorganic pigment and a synthetic polymer latex as a binder is prepared and applied to the paper surface and the paper is subsequently dried to produce a coated paper, the improvement which comprises using as the synthetic polymer latex a carboxylated latex, the carboxylation being such that the latex swells substantially during the preparation of the coating composition and shrinks during the drying of the coated paper to produce microscopic roughness on the dried coated paper surface, whereby a low sheet gloss, high ink gloss coated paper is obtained.

2. The improvement of claim 1 wherein the latex particles swell in the aqueous coating composition to at least about twice their volume.

3. The improvement of claim 1 wherein the carboxylated latex is a styrene/butadiene/vinyl acid based latex containing at least about 6 parts of a vinyl acid monomer per 100 parts of total monomers.

4. The improvement of claim 1 wherein the carboxylated latex is an acrylate/vinyl acid based polymer containing at least about 6 parts of a vinyl acid monomer per 100 parts of total monomers.

5. The improvement of claim 1 wherein the carboxylated latex is a vinyl acetate/vinyl acid polymer latex containing at least about 5 parts of vinyl acid monomer per 100 parts of total monomers.

6. The improvement of claim 1 wherein the pH of the coating composition is increased, whereby a lower sheet gloss coated paper is obtained as compared to a coated paper utilizing the same synthetic latex binder wherein the pH of the coating composition was not increased.

7. The improvement of claim 6 wherein the pH is increased to at least about 8.

8. The improvement of claim 1 including the additional step of calendering the coated paper under conditions which retain the microscopic roughness of the coated paper surface, whereby a calendered low sheet gloss, high ink gloss coated paper is obtained.

9. The improvement of claim 1 wherein the latex has a heterogenous composition.

10. The improvement of claim 1 wherein the coating composition also includes a cobinder.

* * * * *